United States Patent [19]

Tabach

[11] Patent Number: 4,752,071

[45] Date of Patent: Jun. 21, 1988

[54] METHOD OF ALIGNING STRINGS IN A RACKET

[76] Inventor: Julius Tabach, 10102 Empyrean Way #201, Los Angeles, Calif. 90067

[21] Appl. No.: 16,934

[22] Filed: Feb. 20, 1987

[51] Int. Cl.[4] ..... A63B 49/00

[52] U.S. Cl. ..... 273/73 R

[58] Field of Search ..... 273/73 A, 73 R, 73 D, 273/73 B; 248/220.4

[56] References Cited

U.S. PATENT DOCUMENTS

| | | | |
|---|---|---|---|
| 1,924,451 | 8/1933 | McClarkey | 16/114 R |
| 2,868,386 | 1/1959 | Seyforth | 248/220.4 X |
| 3,014,597 | 12/1961 | McWherter | 248/220.4 X |
| 3,200,960 | 8/1965 | Banse | 248/220.4 X |
| 3,244,390 | 4/1966 | Kerr | 248/220.4 |
| 3,534,864 | 10/1970 | Larson | 248/220.4 |
| 4,560,062 | 12/1985 | Valiulis | 248/220.4 X |

*Primary Examiner*—Richard C. Pinkham
*Assistant Examiner*—Matthew L. Schneider
*Attorney, Agent, or Firm*—Matthew F. Jodziewicz

[57] ABSTRACT

A device for straightening misaligned strings of a stringed racket, including an elongated rigid member forming a substitute finger. One end of the device includes a gripping member for gripping the device and a hook is supported from the other end of the elongated member and extending transversely thereto. The hook has both forwardly facing and rearwardly facing bent portions, so that it may be used alternately for pushing or pulling a selected string.

3 Claims, 1 Drawing Sheet

METHOD OF ALIGNING STRINGS IN A RACKET

BACKGROUND OF THE INVENTION

1. Field of the Invention

This invention relates in general to a device and a method for aligning misaligned strings, and, more particularly, to a device and a method for realigning misaligned strings in stringed rackets such as tennis or squash rackets.

2. Description of the Related Art

When a ball is struck with a racket, as in tennis or squash, the strings of the racket undergo deforming forces that tend to force the racket strings from their desired orthogonal, grid-like relationships into misalignment. Unless corrected, the next time the ball is hit by the racket, the ball will not receive the driving force exerted by a uniform grid-like pattern of intersecting strings, but will receive an irregular transmission of force that may result in the ball assuming a unwanted trajectory. Since most racket games depend upon the skill of the players in imparting "spin" to the ball so as to purposely vary its trajectory to cause a desired movement in the other player, the irregular and unpredictable nature of the forces being imparted to the ball from a racket having misaligned strings is both disconcerting and highly undesirable.

The problem is compounded by the fact that players cannot carry bulky alignment devices with them while in play as racket games generally involve strenuous movement on the part of the players which would be hampered by unnecessary weiqht. Likewise, the players require an alignment device that is simple and easy to use that can quickly align the misaligned strings with a minimum of time loss for them.

The prior art known to the applicant involves a player using his finger tips inserted in between the strings of the racket and pulling the misaligned strings into what is hoped is an aligned position. The problems with this prior art approach are that it is first somewhat painful on the finger tips, and secondly, that in many instances the player's hand blocks his view of the particular string that he is attempting to realign thereby preventing proper alignment of the particular string without undergoing a series of pull-and-check operations.

The present invention overcomes both the problem of misaligned strings and those limitations noted for the prior art "finger tip" method of alignment.

Specifically, the present invention permits the use of a small, non-bulky, lightweight tool that allows for easy use, quick alignment of a particular string, and a clear visual inspection of the alignment procedure while it is being done. The tool described below embodying a preferred embodiment of the present invention also safeguards a player's finger tips from the sometimes painful experience of realignment.

SUMMARY OF THE INVENTION

It is an object of the present invention to provide a tool that is lightweight and non-bulky and that allows for easy use in the quick alignment of a particular string while permitting its user a clear view of the alignment operation.

It is another object of the present invention to provide a method for alignment of a particular string that is quick, painless to the employer of the method and efficient.

It is yet another object of the present invention to provide a tool that is easy to manufacture, efficient to use, and requires little to no maintenance.

In summary, the present invention is embodied in a device for straightening misaligned strings of a stringed racket, including an elongated rigid member forming a substitute finger. Gripping means are on one end of the elongated member and a hook is supported from the other end of the elongated member and extending transversely thereto. The hook has both forwardly facing and rearwardly facing bent portions, so that it may be used alternately for pushing or pulling a selected string.

Likewise, the method of the present invention provides, in summary, a method for a user aligning a selected string in a stringed racket and includes the steps of the user grasping the stringed racket firmly in one of his hands, and in his other hand grasping a device having an elongated rigid member forming a substitute finger, gripping means on one end of the elongated member, and a hook supported from the other end of the elongated member and extending transversely thereto. The hook of the device has both forwardly facing and rearwardly facing bent portions, so that it may be used alternately for pushing or pulling the selected string. The user inserts the hook portion of the device into the interstices formed by the strings in the racket for engaging the proximal side of the selected string that he wishes to align. The user engages the proximal side of a rearwardly misaligned portion of the selected string with the forwardly facing portion of the device and pushing the rearwardly misaligned portion of the selected string forward realigns this string portion to his visual approval. The user now retracts the hook portion of the device from its engagement with the proximal side of the selected string and inserts the hook portion of the device into the interstices formed by the strings in the racket for engaging the distal side of the selected string. The user now uses the device to engage the distal side of a forwardly misaligned portion of the selected string with the rearwardly facing portion of the device and pulls the forwardly misaligned portion of the selected string rearward until it meets his visual inspection approval. When the two misaligned strings are adjacent, the hook portion does not need to be removed from the interstice or space between the strings.

The novel features of construction and operation of the invention will be more clearly apparent during the course of the following description, reference being had to the accompanying drawings wherein has been illustrated a preferred form of the device of the invention and wherein like characters of reference designate like parts throughout the drawings.

DESCRIPTION OF THE PREFERRED EMBODIMENTS

Figure 1:
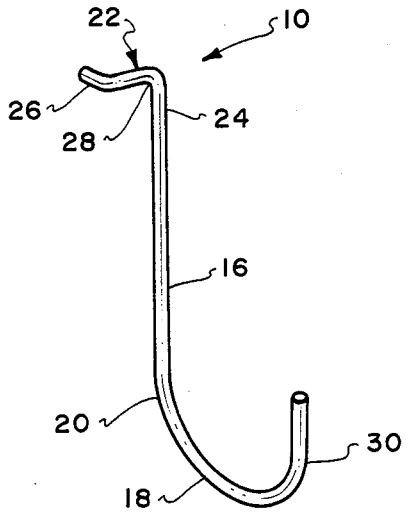
FIG. 1 is a side view of a tool constructed in accordance with and embodying the present invention.
Figure 2:
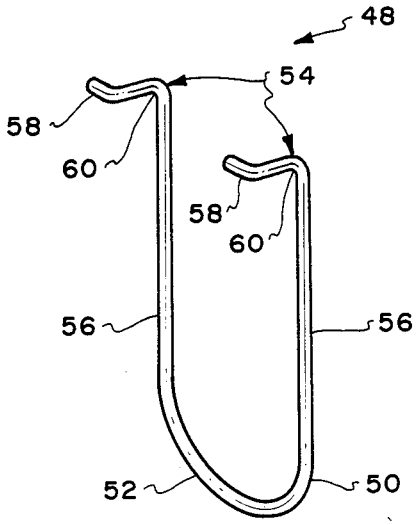
FIG 2 is a perspective view of an alternate tool constructed in accordance with and embodying the present invention.

FIGS. 1 and 2 show two constructions of the present invention embodied in a device 10 for straightening misaligned strings 12 of a stringed racket 14. The tool of FIG. 1 will be described first.

Device 10 includes an elongated rigid member 16 which forms a substitute finger. Gripping means 18 are on one end 20 of the eIongated member 16 and a hook 22 is supported from the other end 24 of the elongated member 16 and extends transversely thereto.

The hook 22 has both forwardly facing and rearwardly facing bent portions 26, 28, respectively, so that the hook 22 may be used alternately for pushing or pulling a selected string.

Gripping means 18 are preferably an arcuate section 30 formed on end 20 of the elongated rigid member 16 and provides a rather comfortable section for gripping between the fingers of a hand. Gripping means 18 may also have arcuate section 30 formed on end 20 of the elongated rigid member 16 encased in a plastic material that is formed to provide a handle specifically adapted for being grasped between the fingers of a human hand.

Device 10 is preferably formed from either a plastic material or from an integral piece of metal wire. These two materials are preferred, as they are both resistant to damage, easy and cheap to manufacture, and have structural properties that permit them to rigidly transmit a user's applied aligning force to a specific portion of a selected string.

Alternate tool 48 includes an elongated U-shaped rigid member 50 which forms a substitute finger. Arcuate section 52 of U-shaped rigid member 48 forms a gripping means that provides a rather comfortable section for gripping between the fingers of a hand.

A pair of hooks 54 is supported from the extending arms 56 of the U-shaped rigid member 50 and each extends transversely thereto. Each of the hooks 54 has both forwardly facing and rearwardly facing bent portions 58, 60, respectively, so that the hooks 54 may be used alternately for pushing or pulling a selected string.

Like the first construction of a tool described above, the alternate tool 48 is preferably formed from either a plastic material or from an integral piece of metal wire. These two materials are preferred, as they are both resistant to damage, easy and cheap to manufacture, and have structural properties that permit them to rigidly transmit a user's applied aligning force to a specific portion of a selected string.

The present invention also provides a method for a user aligning a selected string or selected strings in a stringed racket.

Figure 3:
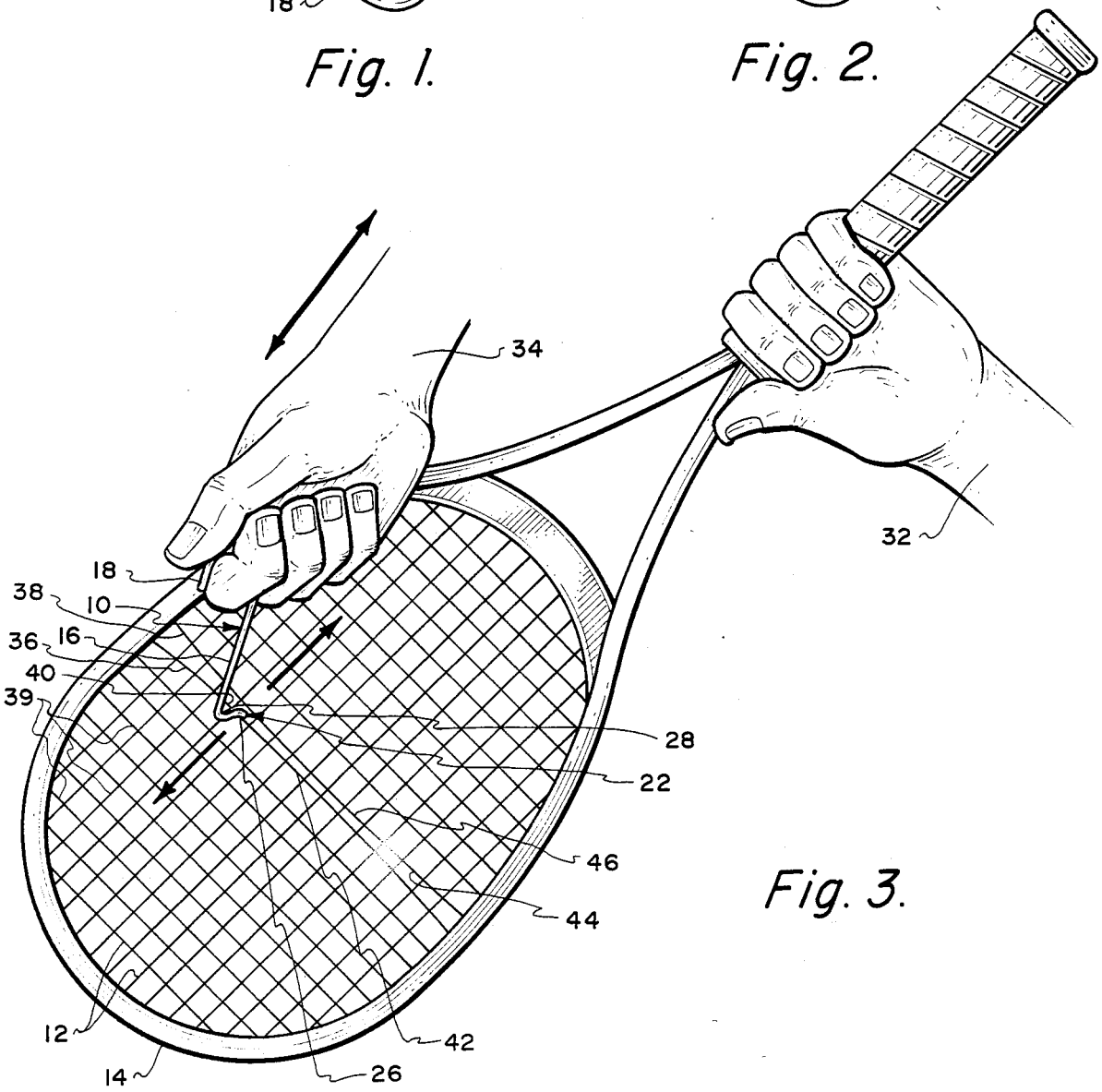
FIG. 3 shows how the tool of the present invention is used in aligning strings in a stringed racket.

The method of the present invention is shown in FIG. 3, as it would be applied to the situation where the user wishes to align a rearwardly facing portion of a first selected string and a forwardly facing portion of a second selected string that are adjacent one another in the racket and are misaligned towards one another, and includes the following steps.

The user grasps the stringed racket 14 firmly in one of his hands 32, while in his other hand 34 grasping the gripping means 18 of the device 10 preferably between the forefinger and the middle finger of hand 34.

The user chooses a misaligned string 36 and positions the hook portion 22 of the device 10 into the interstices or space formed by the first selected misaligned string 36 and the second selected misaligned string 38 adjacent string 36 in the racket 14. The user positions hook portion 22 of the device 10 for engaging the proximal side 40 of the first selected misaligned string 36 that he wishes to align.

Specifically, the user engages the proximal side 40 of a rearwardly misaligned portion 42 of the first selected string 36 with the forwardly facing bent portion 26 of the device 10. The user then applies force to the elongated rigid member 16 to push the rearwardly misaligned portion 42 of the selected string 36 forward, applying such force until he realigns this rearwardly misaligned string portion 42 to his visual approval using the remaining strings 39 of the racket 14 as a standard of reference.

The user now uses the device 10 to engage the distal side 44 of a forwardly misaligned portion 46 of the second selected string 38 with the rearwardly facing bent portion 28 of the hook portion 22 of the device 10. The user then applies force to the elongated rigid member 16 to pull the forwardly misaligned portion 46 of the second selected string 38 rearward until he realigns this forwardly misaligned string portion 46 to his visual approval using the remaining strings 39 of the racket 14 as a standard of reference.

The method of the present invention when applied to situations in which the rearwardly facing portion of the first selected string and the forwardly facing portion of the second selected string are different linear portions of the same selected string, would include the steps outlined above, and further include a step of removing the hook portion of the device from between the space formed between the proximal side of the selected string and its first adjacent string in the racket and inserting it between the space formed between the distal side of the selected string and its second adjacent string in the racket.

The above description of a preferred embodiment of a tool constructed in accordance with the present invention and of a method in accordance with the present invention discloses specifically that the present invention permits the use of a small, non-bulky, lightweight tool that allows for easy use, quick alignment of a particular string, and a clear visual inspection of the alignment procedure while it is being done.

The tool described, embodying a preferred embodiment of the present invention, also safeguards a player's finger tips from the sometimes painful experience of realignment and is relatively maintenance-free and economical to manufacture.

The method described above provides method for alignment of a particular string that is quick, painless to the employer of the method and efficient.

The invention described above is, of course, susceptible to many variations, modifications and changes, all of which are within the skill of the art. It should be understood that all such variations, modifications and changes are within the spirit and scope of the invention and of the appended claims. Similarly, it will be understood that it is intended to cover all changes, modifications and variations of the example of the invention herein disclosed for the purpose of illustration which do not constitute departures from the spirit and scope of the invention.

What is claimed is:

1. A method for realigning strings in a stringed racket by a user, comprising the steps of:

grasping the stringed racket firmly in a first hand of the user;

selecting a device having an elongated rigid member forming a substitute finger, means for gripping said elongated rigid member on one end of said elongated member, and a hook supported from the other end of said elongated member and extending transversely thereto, said hook having with respect to said end of said elongated member having said means for gripping said elongated member both forwardly facing and rearwardly facing bent portions so that it may be used alternately for pushing or pulling a selected string;

grasping said device by said means for gripping said elongated rigid member in a second hand of the user;

positioning said hook portion of said device so as to engage with respect to a handle of the racket, the proximal side of a rearwardly misaligned first selected string portion with said forwardly facing portion of said hook portion of said device;

pushing with respect to the handle of the racket said device forward with said second hand so as to move said rearwardly misaligned portion of said first selected string forward;

positioning said hook portion of said device so as to engage, with respect to the handle of the racket the distal said of a forwardly misaligned second selected string portion with said rearwardly facing portion of said device; and pulling with respect to the handle of the racket said device rearward with said second hand so as to move said forwardly misaligned portion of said second selected string rearward.

2. A method for realigning strings in a stringed racket by a user, as recited in claim 1, wherein said positioning steps are performed without removing said hook portion of said device from the space formed between said first and second selected strings.

3. A method for realigning strings in a stringed racket by a user, as recited in claim 1, wherein said step of pushing said rearwardly misaligned first selected string portion and said step of pulling said forwardly misaligned second selected string portion are both performed on different linear portions of the same selected string.

* * * * *